US005279668A

United States Patent [19]

Poad et al.

[11] Patent Number: 5,279,668

[45] Date of Patent: Jan. 18, 1994

[54] APPARATUS FOR SPRAYING GLASS CONTAINERS

[75] Inventors: William J. Poad, Perrysburg; Michael T. Dembicki, Pemberville; Thomas E. Wanson, Toledo, all of Ohio

[73] Assignee: Owens-Brockway Glass Container, Inc., Toledo, Ohio

[21] Appl. No.: 12,176

[22] Filed: Feb. 2, 1993

[51] Int. Cl.[5] ..... B05B 3/00

[52] U.S. Cl. ..... 118/323; 118/696; 118/704; 118/705

[58] Field of Search ..... 118/323, 324, 696, 704, 118/705; 92/88

[56] References Cited

U.S. PATENT DOCUMENTS

| | | | |
|---|---|---|---|
| 1,835,402 | 12/1931 | Juers | 118/323 |
| 1,929,896 | 10/1933 | Merritt et al. | 118/323 |
| 2,925,801 | 2/1960 | Bivens et al. | 118/323 |
| 2,926,101 | 2/1960 | Schaefer | 118/323 |
| 3,358,646 | 12/1967 | Libermann | 118/323 |
| 3,516,849 | 6/1970 | Shank et al. | 118/323 |
| 3,924,565 | 12/1975 | Benner et al. | 118/323 |
| 3,985,161 | 10/1976 | Nelson | 118/323 |
| 4,601,234 | 7/1986 | Hoinkis | 92/88 |
| 5,110,632 | 5/1992 | Kawaguchi et al. | 118/313 |
| 5,228,919 | 7/1993 | Baker | 118/323 |

*Primary Examiner*—Robert A. Dawson
*Assistant Examiner*—Sun Uk Kim

[57] ABSTRACT

An apparatus for spraying the surfaces of glass containers which are being moved in longitudinally spaced transverse rows by a conveyor wherein a rodless air cylinder is mounted transversely of the conveyor and the spraying apparatus is connected to the piston of the rodless cylinder so that the spraying apparatus is moved transversely of the rows of containers. The rodless cylinder is supported for pivotal movement about a vertical axis so that the axis of the cylinder may be moved to a position other than a right angle to the longitudinal axis of movement of the conveyor. The offset of the angle from a right angle and the speed of traverse of the piston is coordinated with the conveyor speed so that any time during the travel, the spray apparatus is spraying between the rows being sprayed.

8 Claims, 10 Drawing Sheets

APPARATUS FOR SPRAYING GLASS CONTAINERS

This invention relates to a method and apparatus for applying surface coatings to glass containers.

BACKGROUND AND SUMMARY OF THE INVENTION

It has been known to provide surface coatings to containers as they are moved in rows that extend transversely of a conveyor on which they are supported by providing an overlying spraying apparatus that is moved transversely to the direction of movement of the rows of the containers.

In such apparatus, it is conventional to utilize gearing or chains to move the spray apparatus such as guns transversely of the conveyor. Such apparatus uses a large number of parts, requires substantial time for installation, is expensive to manufacture and maintain and requires complex controls.

It is also known to use a rodless cylinder supported at each end on a carriage with means on each carriage for shifting the angle of the cylinder relative to the direction of movement of the conveyor. The control of this type of apparatus is diffcult and imprecise in ensuring that the spray apparatus moves between the rows of containers as they are moved by the conveyor.

Among the objectives of the present invention are to provide a method and apparatus which overcomes these disadvantages and provides a system for moving spray guns transversely; which provides more accurate movement and control of the spray pattern such that the coating is applied to the surface of the container between the moving rows of containers; which permits acceleration and deceleration from each end of the stroke of the apparatus transversely; which requires minimum maintenance; and which can be utilized in either a continuous mode or a row follower mode.

In accordance with the invention, a method and apparatus is provided for spraying the surfaces of glass containers which are being moved in longitudinally spaced rows by a conveyor wherein a rodless air cylinder is mounted transversely of the conveyor and the spraying apparatus is connected to the piston of the rodless cylinder so that the spraying apparatus is moved transversely of the rows of containers. The rodless cylinder is supported for pivotal movement about a vertical axis so that the axis of the cylinder may be moved to a position other than a right angle to the longitudinal axis of movement of the conveyor. The offset of the angle from a right angle and the speed of traverse of the piston is coordinated with the conveyor speed so that any time during the travel, the spray apparatus is spraying between the rows being sprayed.

DESCRIPTION

Referring to FIGS. 1–4, the apparatus embodying the invention is adapted to be used in spraying rows of containers C that are moved along a conveyor 10 that may be part of a lehr conveyor used to transport glass containers through an annealing lehr, the apparatus being positioned at the exit of the annealing lehr.

Figure 1:
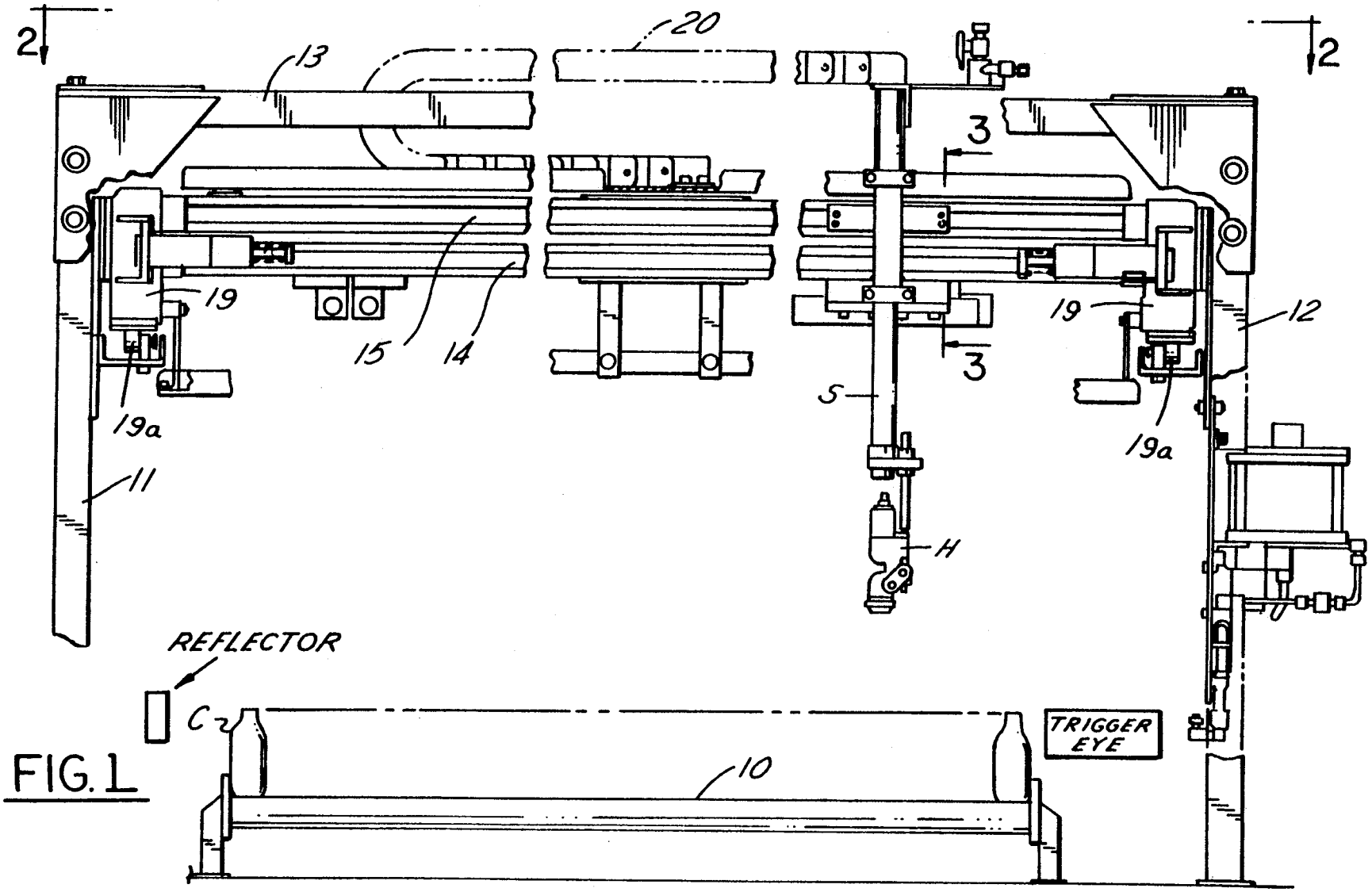
FIG. 1 is a transverse elevational view of an apparatus embodying the invention.

The apparatus comprises supporting columns 11, 12 and transverse beams 13. One or more rodless cylinders 14, 15 are pivotally suspended for movement about a vertical axis on a pin 18 pivoted to bracket 17 extending horizontally from the top beam 13. Each carriage 19 is supported on rollers **16*a* mounted on the frame (FIG. 1**).

Each cylinder 14, 15 is of the well known rodless cylinder construction which includes a cylinder barrel having a slot along its length. A piston is mounted within the cylinder and is moved by air being selectively applied to one or the other end of the piston. The piston includes a portion extending through the slot and a seal seals the interior of the cylinder from leakage through the slot as the piston is moved along the cylinder barrel. A typical rodless cylinder is sold by Origa Corporation, Elmhurst, Ill. A bracket 16 is connected to the pistons of the cylinders 14, 15 and the spray delivery apparatus S is mounted on bracket 16 and includes one or more spray guns or heads H for directing liquid on the containers. The spray delivery apparatus S is provided with the spray liquids through hoses that are guided by a flexible and foldable track 20.

Figure 2:
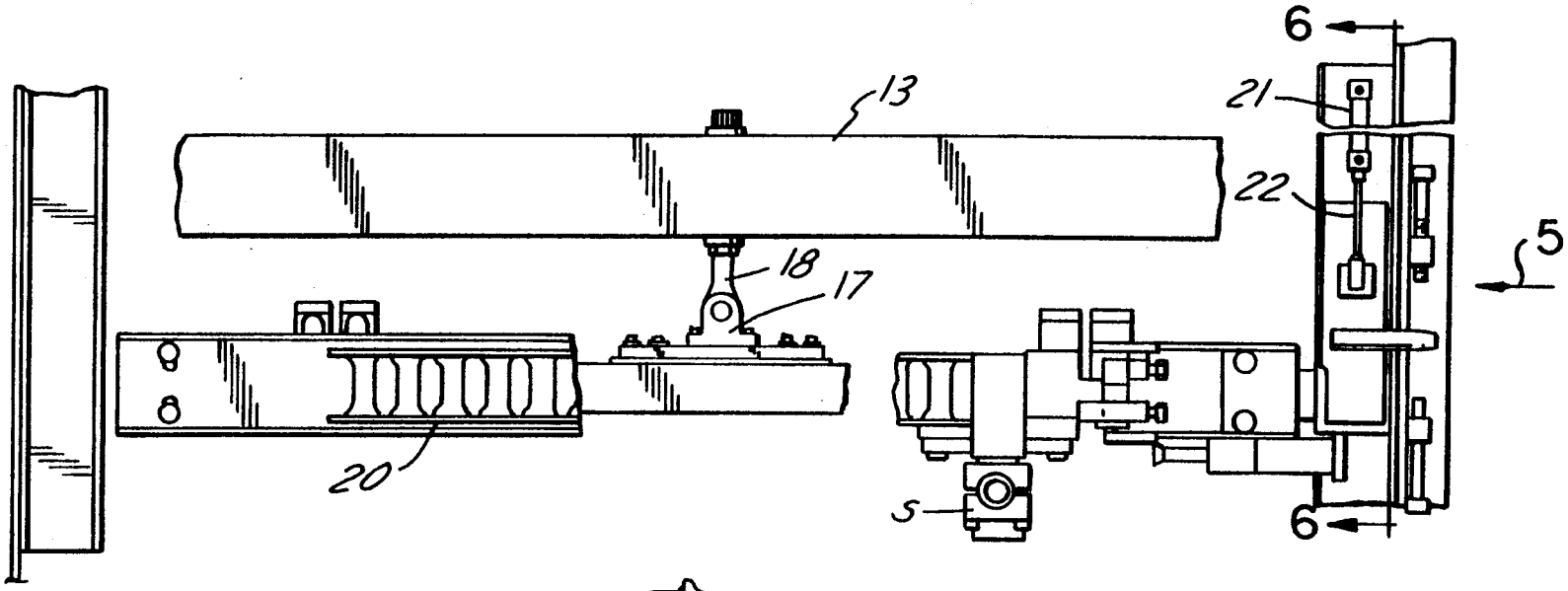
FIG. 2 is a fragmentary plan view taken along the line 2—2 in FIG. 1.
Figure 3:
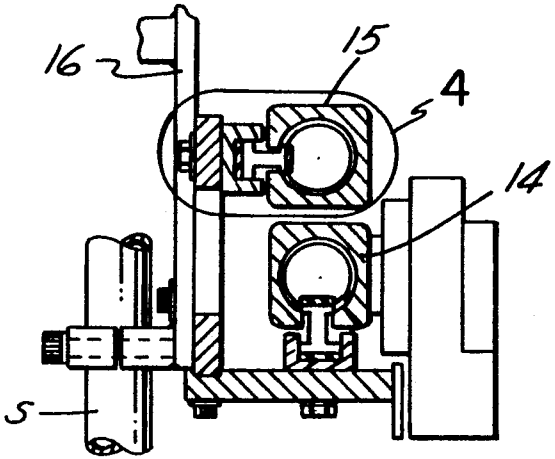
FIG. 3 is a sectional view taken along the line 3—3 in FIG. 1.
Figure 4:
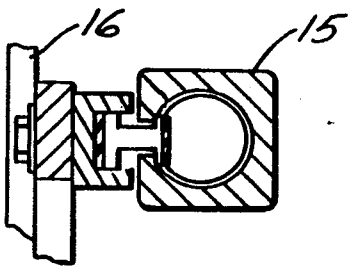
FIG. 4 is a view of a portion of the apparatus shown in FIG. 3 taken at 4.
Figure 5:
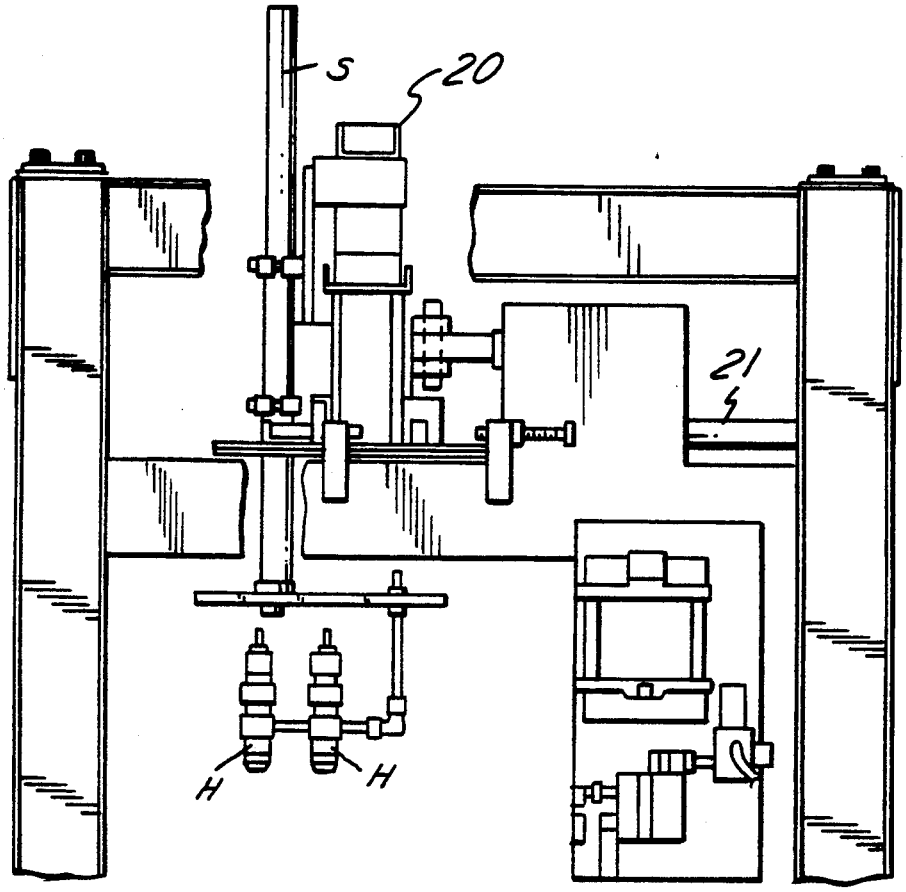
FIG. 5 is a view taken in the direction of the arrow shown in FIG. 2.
Figure 6:
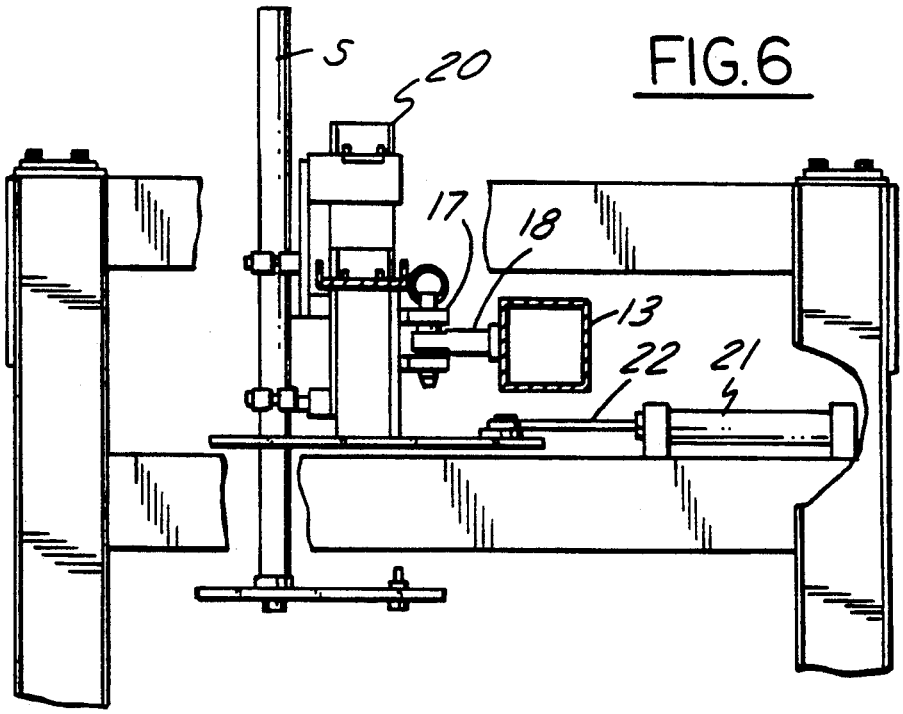
FIG. 6 is a fragmentary sectional view taken along the line 6—6 in FIG. 5.

Referring to FIGS. 2 and 6, a single fluid cylinder 21 is mounted on the fixed portion of the apparatus and has a piston rod 22 connected to each carriage 16 so that the angle which the axis of the cylinders makes with respect to the longitudinal axis of movement of the conveyor can be changed to positions ranging from perpendicular to the conveyor or having one or the other end of the cylinders leading. As a result, the cylinders can be moved to what might be termed an X pattern or relationship as may be required.

With the cylinder positioned perpendicular to the conveyor, the spray apparatus can be operated either continuously or intermittently to apply the coatings to the containers.

Figure 7:
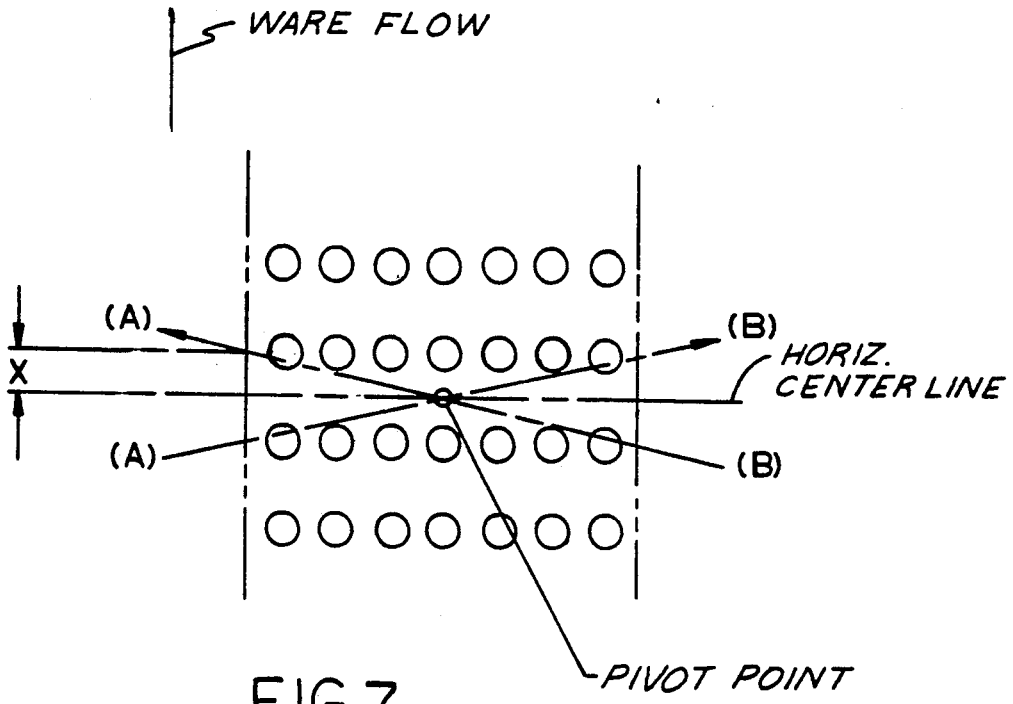
FIGS. 7–12 are schematic diagrams showing the manner in which an X-pattern spray can be provided for spraying between the rows of containers.

Referring to the diagrams shown in FIGS. 7–12, the angle and associated speeds of the various components can be adjusted in order to spray between rows of containers. As seen in FIG. 7, the amount of offset X, the speed of the spray gun carrier 19 as determined by speed of operation of the rodless cylinder across the conveyor and the speed of the conveyor when set properly, the vectors created (A)(B) and (B)(A) are such that any time during the travel the spray guns will be positioned between the rows being sprayed.

Figure 8:
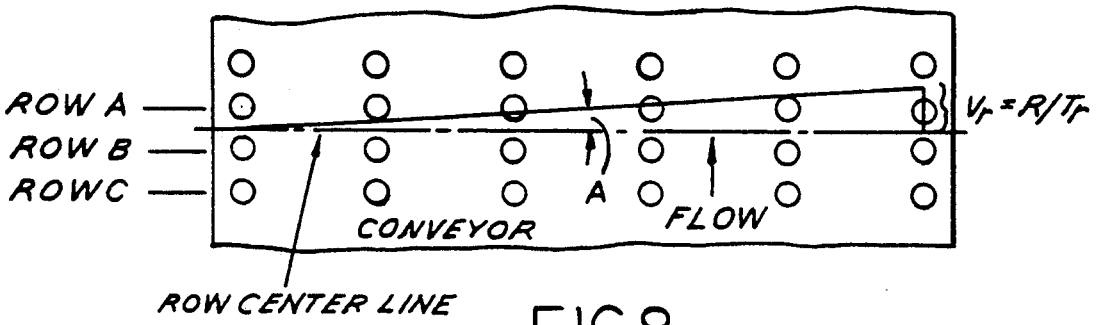

Referring to FIG. 8, the time, Tr, and distance, R, required to advance one row (one cycle) is shown by the inclined line. The row-to-row velocity is $Vr=R/Tr$. A line connecting the start point to the end point (one transverse) shows how a sprayer must travel to stay between the rows of containers.

Figure 9:
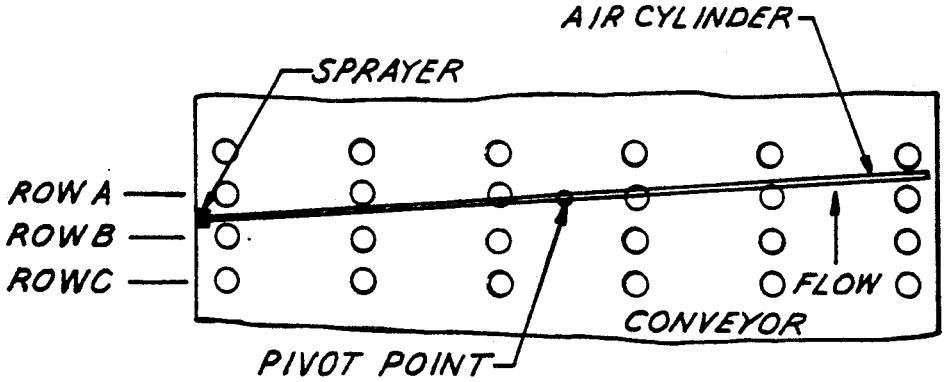

FIG. 9 shows an air cylinder with sprayer attached at the end of one traverse.

Figure 10:
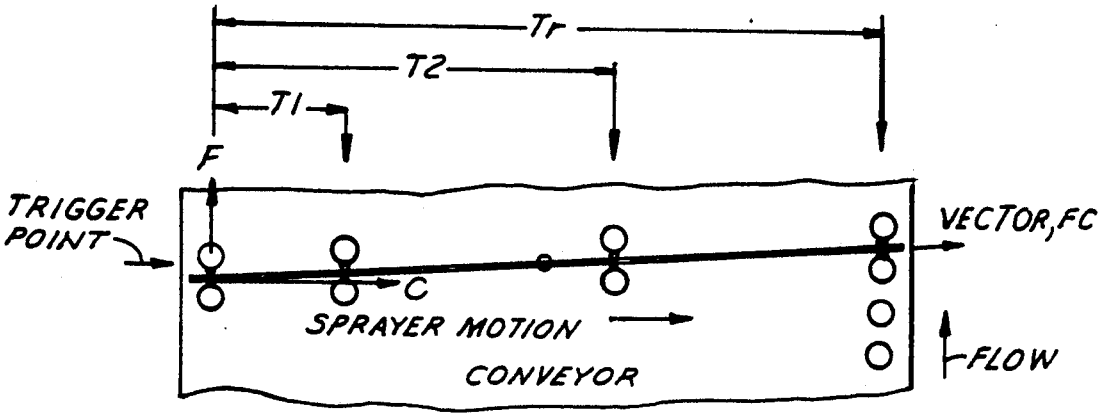
Figure 11:
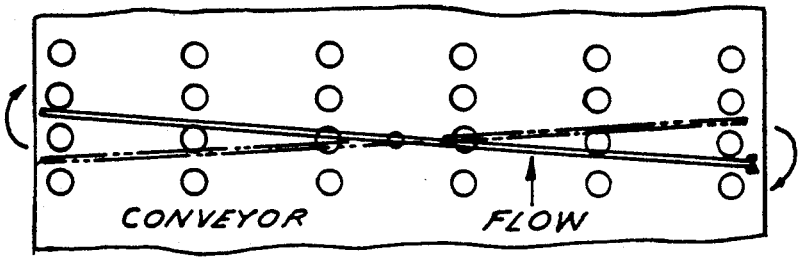

Referring to FIGS. 10 and 11, the operation of a reverse traverse is as follows:

1. The air cylinder is set at an angle A, the sprayer waits at end of cylinder on down stream side.

2. The passage of row "A" of containers triggers the sprayer.

3. A wait (on delay) timer allows row "A" to pass before spray cycle starts.

4. The air cylinder receives an air signal which pushes the piston (and sprayer) across the lehr. The air cylinder itself does not pivot or change angle at this time.

5. The sprayer is set to move at a velocity, $V_s = C/Tr$ (by control of air flow) so its motion along vector, FC, carries it forward to reach the opposite side of the air cylinder in time Tr. The vector (angle and speed) accounts for the motion of the bottles forward.

6. When the sprayer reaches the opposite side, the air cylinder "shifts" so that it can start another full cycle and spray the opposite direction when triggered by the next row.

Referring to FIG. 11, air cylinder has "shifted", ready to spray between the rows on a return traverse of the spray gun carrier 19.

Figure 12:
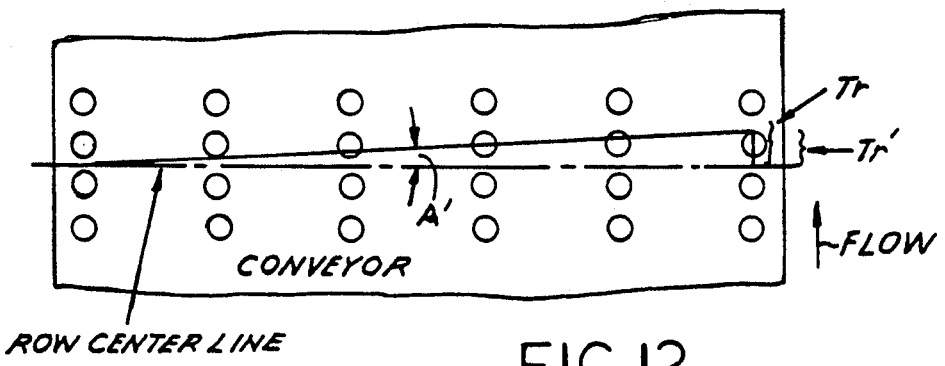

Referring to FIG. 12, during operation, if it is necessary to increase $V_s$, such that the sprayer reaches the opposite side in Tr', where $O < Tr' < Tr.$, the extra time, $Tx = Tr - Tr'$ is used to "shift" the cylinder before the next row starts the new cycle. Accordingly, the angle of the air cylinder is set to a smaller angle A'.

Figure 13:
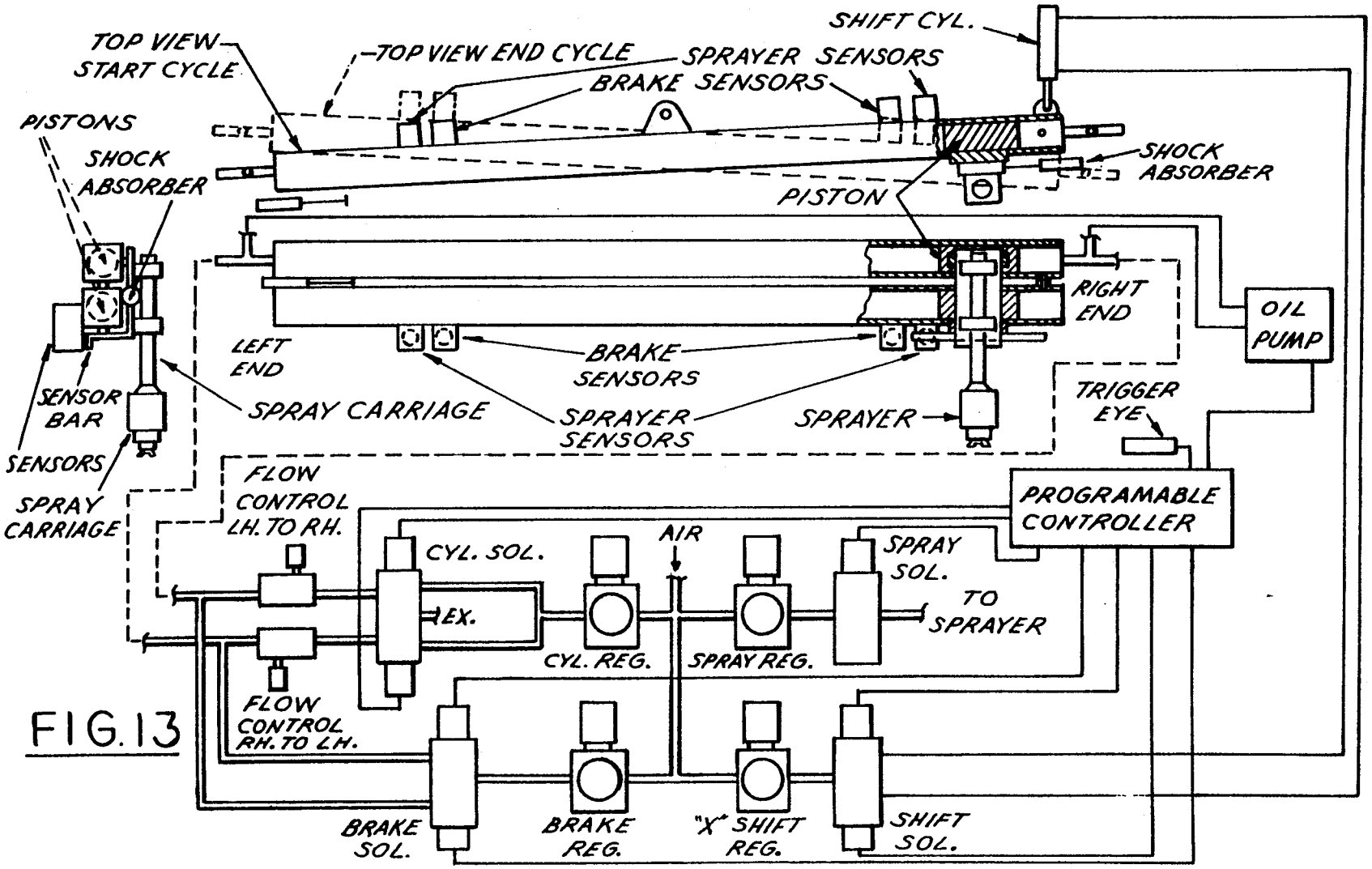
FIGS. 13–17 are combined mechanical, pneumatic, lubricating and electric diagrams showing the operation of the apparatus in various portions of a cycle.

FIG. 13 indicates the general relative lay out of the various components.

Figure 14:
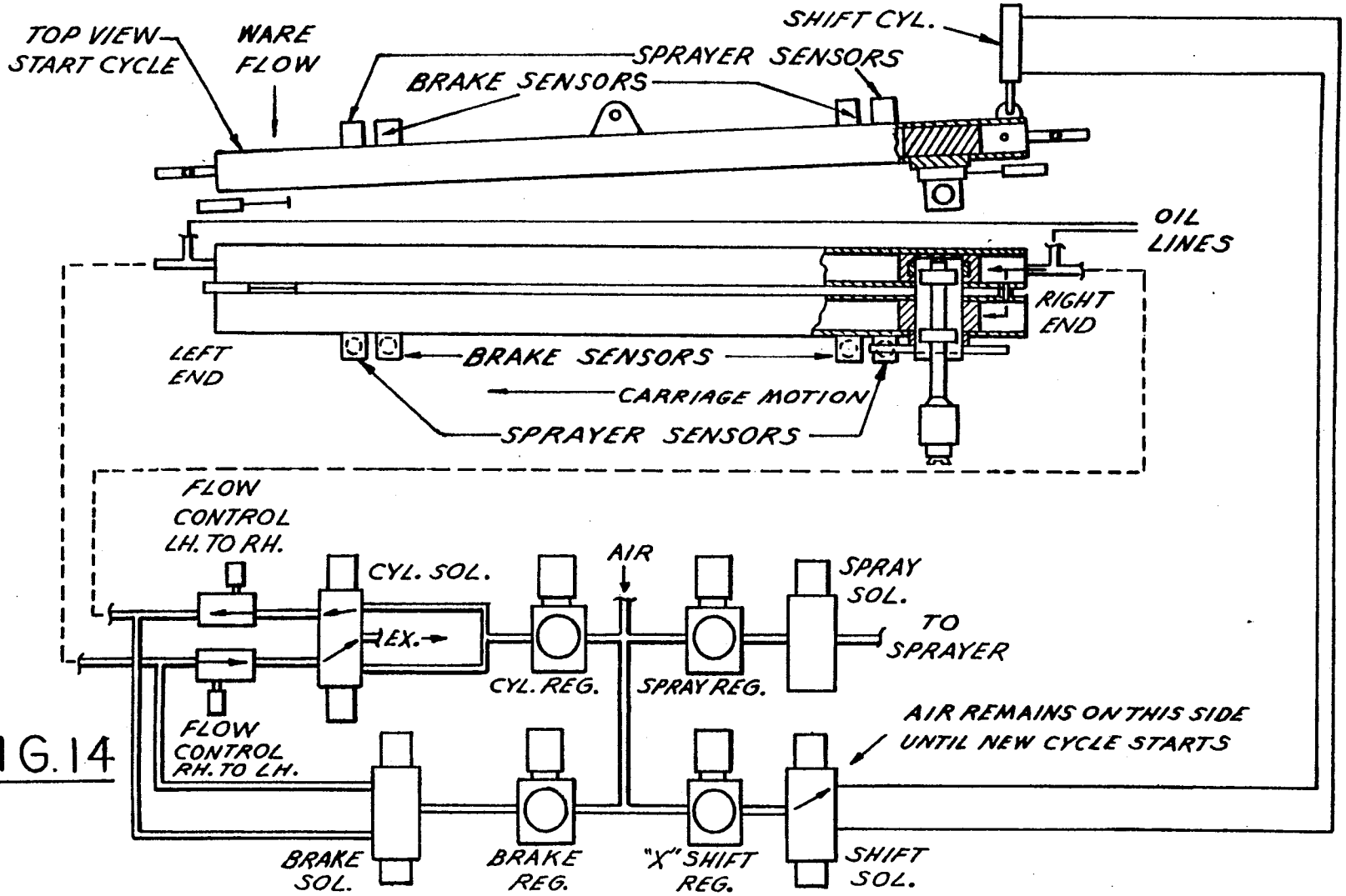

FIG. 14 shows the relative positions at the beginning of a cycle. The CYLINDER SOLENOID valve receives a signal from the PROGRAMMABLE CONTROLLER (from the TRIGGER EYE photocell, FIG. 1) to direct air to the right side of the CYLINDERS. Since both cylinders are joined internally, the PISTONS will begin to move simultaneously. The pistons are mechanically linked to the SPRAY CARRIAGE.

Figure 15:
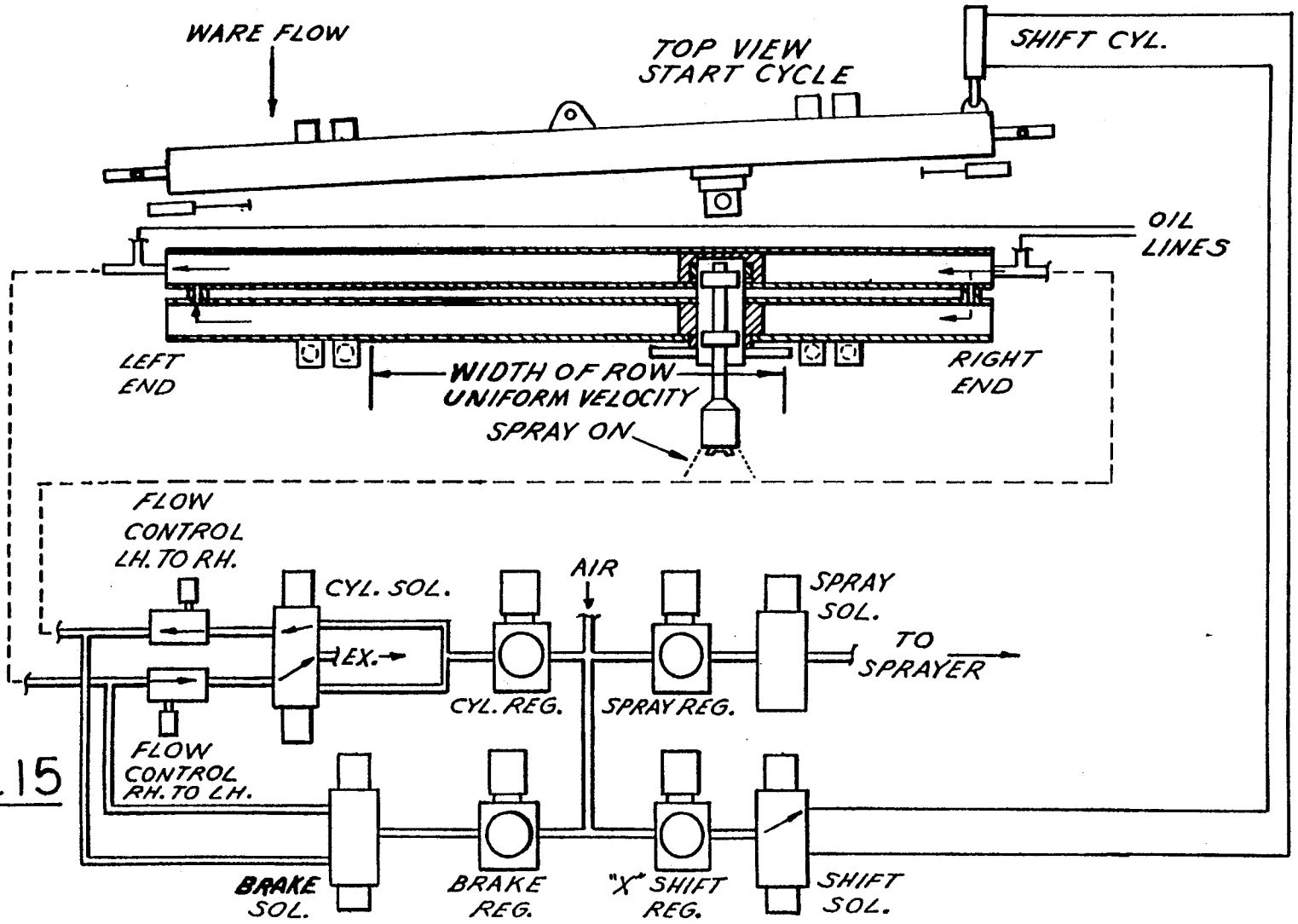

Referring to FIG. 15, as the RH SPRAY SENSOR is uncovered by a SENSOR BAR when it moves pass the SENSOR, programmable controller energizes the SPRAY SOLENOID to turn the SPRAYER on.

Figure 16:
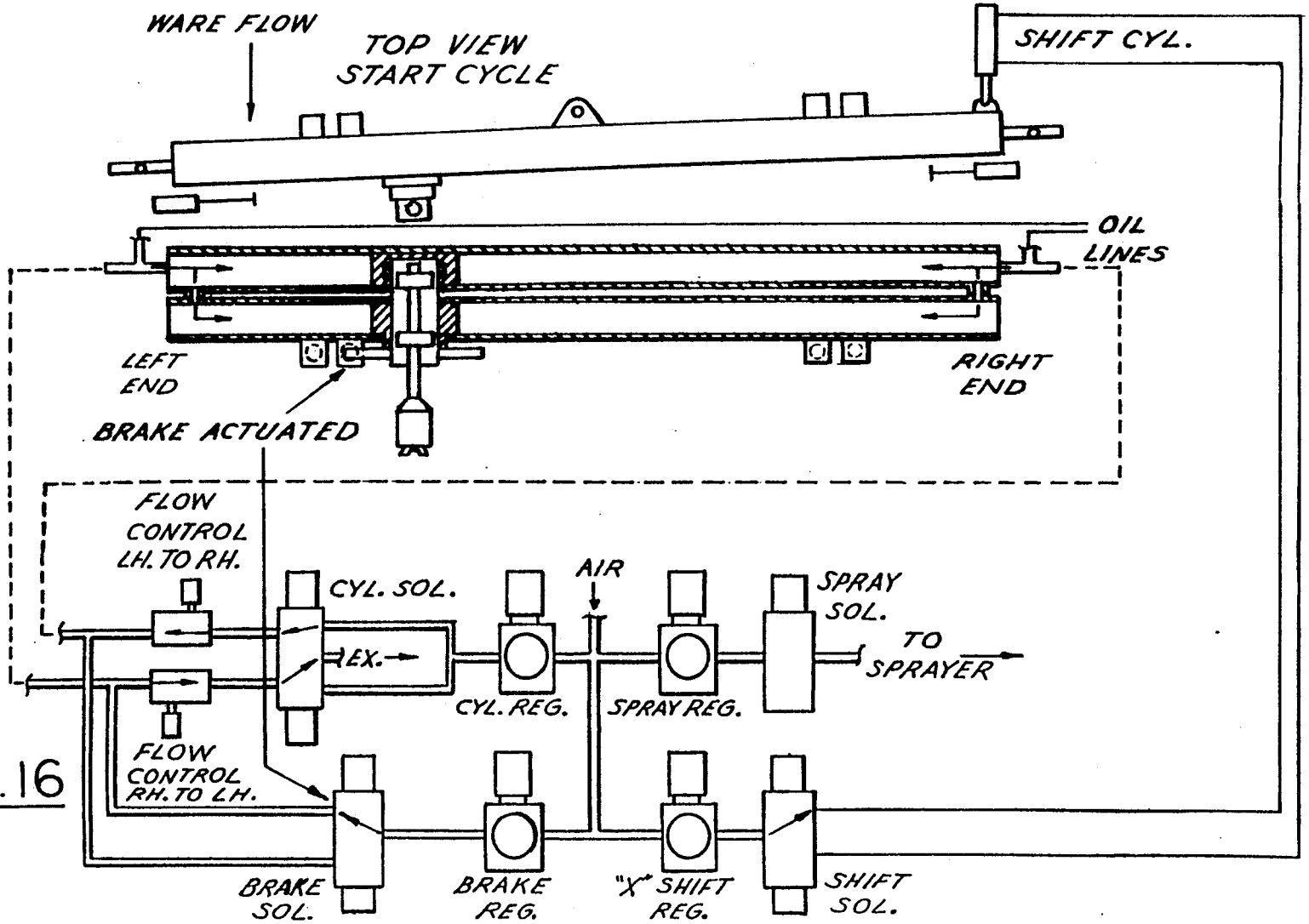

As air pushes on the right side of the PISTONS, air on the left side exhausts through the RT TO LFT FLOW CONTROL, CYLINDER SOLENOID valve and EXHAUST PORT. The velocity of the carriage, $V_s$ is set by these flow controls Referring to FIG. 16, as the CARRIAGE reaches the left side, the SENSOR BAR covers the left BRAKE SENSOR, causing the BRAKE SOLENOID to apply air to left side of the PISTONS. The BRAKE air pressure is sufficient to slow the speed of the PISTON/-CARRIAGE assembly. The BRAKE air continues as long as the SENSOR BAR covers the BRAKE SENSOR.

Figure 17:
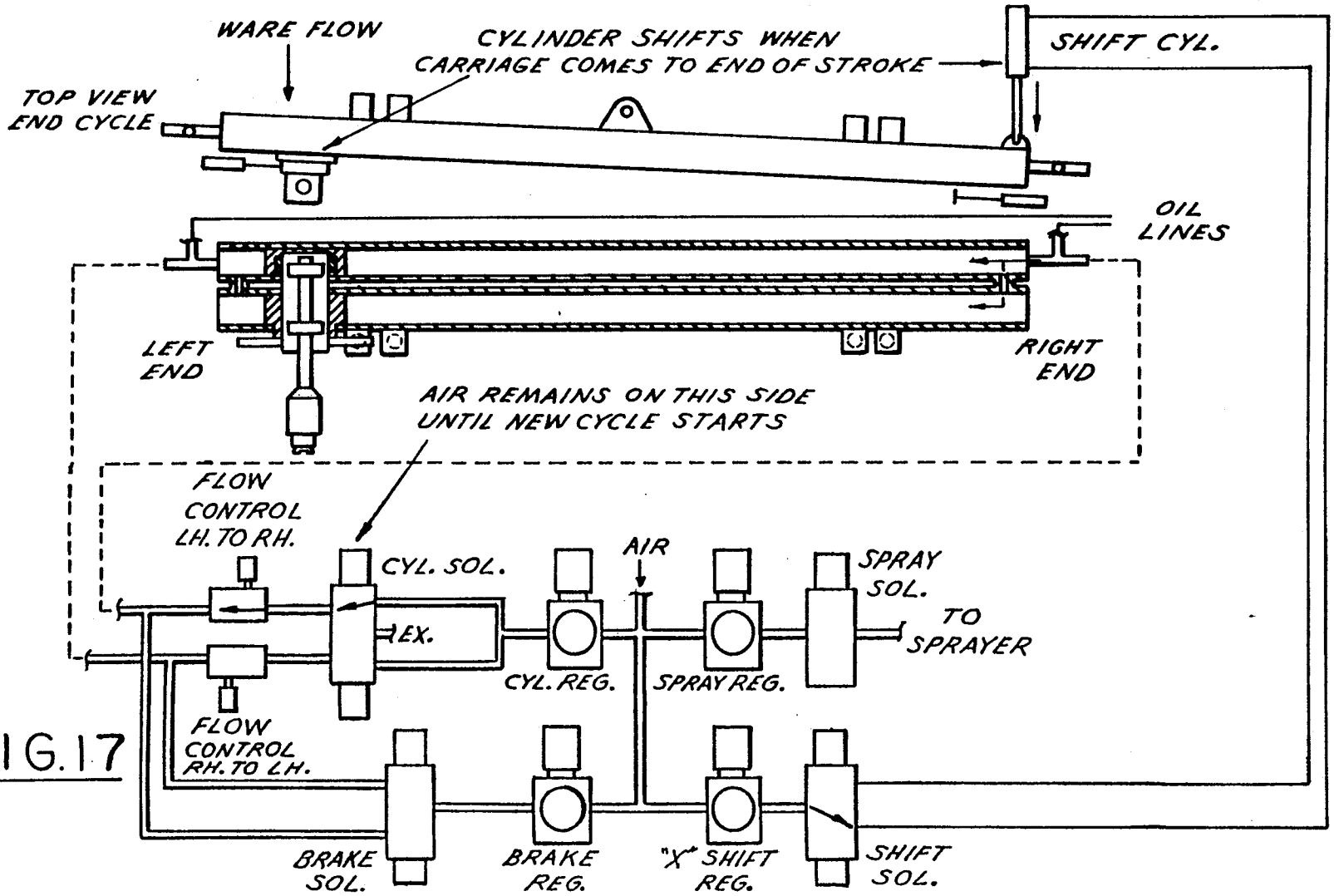

Referring to FIG. 17, when the SENSOR BAR covers the left SPRAY SENSOR, the sprayer is turned off. The CARRIAGE is slowed even more and finally stopped by the left SHOCK ABSORBER. The SHIFT SOLENOID valve receives a signal from the PROGRAMMABLE CONTROLLER, causing an air signal to be sent to the SHIFT CYLINDER.

As shown in FIG. 13, the PROGRAMMABLE CONTROLLER functions to periodically operate a pneumatic piston pump to inject oil at a point where the air enters the air cylinder ensuring that there is a presence of oil on the piston seals when the piston stops at the end of its stroke.

It can thus be seen that there has been provided a method and apparatus which overcomes these disadvantages and provides a system for moving spray guns transversely; which provides more accurate movement and control of the spray pattern such that the coating is applied to the surface of the container between the moving rows of containers; which permits acceleration and deceleration from each end of the stroke of the apparatus transversely; which requires minimum maintenance; and which can be utilized in either a continuous mode or a row follower mode.

We claim:

1. An apparatus for applying surface coatings to glass containers as they are moved in rows that extend transversely by a conveyor moving longitudinally comprising cylinder means comprising a cylinder barrel and a piston movable in said cylinder barrel, means for supporting said cylinder means for pivoting movement about a vertical axis, actuator means connected solely to one end of said cylinder means for shifting said cylinder means such that said cylinder barrel can be positioned so that its axis is in a plurality of positions including a right angle and acute angles relative to the direction of movement of the conveyor, means for mounting spray apparatus on said piston such that as the piston is reciprocated by selective application of air on opposite ends of the cylinder barrel the spray apparatus is moved transversely.

2. The apparatus set forth in claim 1 wherein said vertical pivotal axis is substantially at the center of the apparatus with respect to the conveyor.

3. The apparatus set forth in claim 2 wherein said cylinder means comprises a pair of rodless cylinder barrels.

4. The apparatus set forth in claim 1 including programmable controller means for controlling the movement of said spray apparatus such that the spray apparatus is moved in a first transverse direction overlying a conveyor, moving containers in parallel transverse rows, at an acute angle to a transverse axis of the conveyor and thereafter the cylinder means is pivoted such that the spray apparatus is moved in the opposite direction transversely of the conveyor, and the movement of the spray apparatus is controlled such that the spray apparatus travels between row of containers in both directions.

5. The apparatus set forth in claim 4 including lubricating means operable by said programmable controller means for delivering a lubricant to the piston of the cylinder means as it reaches one end of its stroke.

6. The apparatus set forth in claim 5 including air brake means operable by said programmable controller for applying a burst of air to opposite ends of the piston as the spray apparatus approaches the end of the stroke.

7. The apparatus set forth in claim 6 including shock absorber means at each end of the stroke of the cylinder means.

8. The apparatus set forth in any one of claims 1–7 wherein said programmable controller means is responsive to a signal for beginning a cycle of movement of said piston of said cylinder means in a first direction;

a signal in response to movement of the spray apparatus into overlying relation to the glass containers to energize the spray apparatus, a signal to deenergize the spray apparatus when the spray apparatus passes the conveyor in said first direction, a signal when the piston approaches the end of its movement in one direction to energize an air brake;

and a signal when the piston reaches the end of its movement to energize the actuator means for shifting the axis of said cylinder means;

and a signal for reversing the operation of the cylinder means to move the spray apparatus in a second direction toward the initial position;

a signal for energizing the spray apparatus as the spray apparatus is moved into overlying relation to the container, a signal for deenergizing the spray apparatus when the spray apparatus passes the conveyor in said second direction;

and a signal responsive to the approach of the piston to its original position to apply an air brake to slow the speed of the piston.

* * * * *